United States Patent [19]

Zaborowski

[11] Patent Number: 4,924,849

[45] Date of Patent: May 15, 1990

[54] PORTABLE HEATING APPLIANCE HAVING FUEL CARTRIDGE WITH ON/OFF SWITCH

[75] Inventor: Thaddeus Zaborowski, Cambridge, Mass.

[73] Assignee: The Schawbel Corporation, Cambridge, Mass.

[21] Appl. No.: 230,304

[22] Filed: Aug. 9, 1988

Related U.S. Application Data

[63] Continuation-in-part of Ser. No. 174,789, Nov. 9, 1987, Pat. No. 4,815,441, which is a continuation of Ser. No. 781,262, Sep. 27, 1985, Pat. No. 4,733,651.

[51] Int. Cl.[5] ..... A45D 1/04

[52] U.S. Cl. ..... 126/409; 126/408; 132/228

[58] Field of Search ..... 126/409, 402, 403, 404, 126/405, 406, 408, 409, 410, 411, 413; 132/118, 220, 223, 227, 228

[56] References Cited

U.S. PATENT DOCUMENTS

| | | | |
|---|---|---|---|
| 4,321,934 | 3/1982 | Diederich | 132/228 |
| 4,635,382 | 1/1987 | Bourdeau | 126/409 X |
| 4,759,343 | 7/1988 | Schawbel et al. | 126/409 |

FOREIGN PATENT DOCUMENTS

| | | | |
|---|---|---|---|
| 01916 | 4/1987 | PCT Int'l Appl. | 126/409 |

*Primary Examiner*—Larry Jones

*Attorney, Agent, or Firm*—Peter L. Berger

[57] ABSTRACT

A portable heating appliance having a member to be heated, includes first and second burners for heating the member; a portable fuel cartridge for supplying fuel to the burners, the furel cartridge including a fuel delivery valve for controlling the flow of fuel from the fuel cartridge, the fuel delivery valve including a control device for preventing the flow of fuel when in a first position and for permitting the flow of fuel when in a second, different position, and a first spring for biasing the control device to the first position; a plunger for actuating the fuel delivery valve in response to user actuation to start the flow of fuel from the fuel cartridge, the plunger pushing in the control device from the first position to the second position against the force of the spring to open the fuel delivery valve so that the latter permits the flow of fuel to the burners; the fuel cartridge further including a ring rotatably mounted on the housing of the cartridge and connected with the fuel delivery valve for moving the fuel delivery valve of the fuel cartridge between an active position to enable actuation of the control device thereof by the plunger and an inactive position at which the control device is not actuated by the plunger; and a regulator for maintaining a substantially temperature of the burners.

22 Claims, 2 Drawing Sheets

PORTABLE HEATING APPLIANCE HAVING FUEL CARTRIDGE WITH ON/OFF SWITCH

REFERENCE TO RELATED APPLICATIONS

This application is a continuation-in-part of U.S. patent application Ser. No. 07/174,784, filed Nov. 9, 1987 now U.S. Pat. No. 4,815,441 3/28/89, and entitled "Portable Heating Appliance" to William Schawbel et al., which in turn, is a continuation of U.S. patent application Ser. No. 06/781,262, filed Sept. 27, 1985 and entitled "Portable Curling Iron" to William Schawbel et al., now U.S. Pat. No. 4,733,651, all having a common assignee herewith.

BACKGROUND OF THE INVENTION

This invention relates generally to portable heating appliances and, more particularly, is directed to a novel portable curling iron.

A curling iron curls hair by wrapping the hair, tress by tress, around a heated barrel, holding the wrapped tress for a period of time and then unwrapping the tress. The length of time the hair is held wrapped around the barrel, the temperature, the diameter of the barrel and the hair's characteristics largely determine the tightness of the curl.

Some curling irons are portable. These heat the barrel by an electrical heat source or a portable fuel source. Electrical portable curling irons are relatively impractical, but catalytic gas powered curling irons are widely employed. The catalytic converters thereof are powered by butane or similar type gases which may take the form of replaceable or refillable cartridges. Such portable curling irons are widely used, and may be conveniently used almost anywhere.

Catalytic burners for portable curling irons suffer from several disadvantages. First, they are slow to heat, and expensive to manufacture, which are clearly undesirable. Additionally, if the temperature runs too high, the platinum catalyst sinters, reducing surface area, which reduces life.

Still further, catalytic converters can suffer from "hot spots" which can render them dangerous.

OBJECTS AND SUMMARY OF THE INVENTION

Accordingly, it is an object of this invention to provide a system for portable devices requiring a heated portion which eliminates the above-mentioned problems.

It is another object of this invention to provide such a system which may be advantageously used in curling irons.

It is still another object of this invention to provide such a system which may be used with portable irons, portable hot trays, hair roller setters, portable bottle warmers as well as many other portable products.

It is yet another object of this invention to provide such a system which is readily adaptable to portable use, yet which permits rapid heating of the element to be heated.

It is a further object of this invention to provide such a system in which the operating temperature is maintained substantially constant.

It is a still further object of this invention to provide such a system in which a source of fuel is employed which may be rechargeable or refillable.

It is a yet further object of this invention to provide such a system in which the element to be heated rapidly achieves the desired temperature, yet in which the temperature is maintained with decreased fuel consumption.

It is another object of this invention to provide such a system which is safe to use.

It is still another object of this invention to provide such a system in which the fuel cartridge is provided with a rotatable ON/OFF switch.

In accordance with an aspect of the present invention, a fuel cartridge for supplying fuel to burner means of a portable heating appliance of the type having a member to be heated, includes housing means for containing fuel; a well in the housing means for permitting escape of the fuel; fuel delivery valve means for controlling the flow of fuel from the fuel cartridge through the well, the fuel delivery valve means including control means for preventing the flow of fuel when in a first position and for permitting the flow of fuel when biased by an external force to a second, different position, and first biasing means for biasing the stem means of the control means to the first position in a direction opposite to the external force; and moving means for moving the fuel delivery valve means between an active position to enable actuation of the control means by the external force and an inactive position at which the control means is not actuated by the external force.

In accordance with another aspect of the present invention, a portable heating appliance having a member to be heated, includes burner means for heating the member; a portable fuel cartridge for supplying fuel to the burner means, the fuel cartridge including fuel delivery valve means for controlling the flow of fuel from the fuel cartridge, the fuel delivery valve means including control means for preventing the flow of fuel when in a first position and for permitting the flow of fuel when in a second, different position, and first biasing means for biasing the control means to the first position; actuator means for actuating the fuel delivery valve means in response to user actuation to start the flow of fuel from the fuel cartridge, the actuator means including plunger means which pushes in the control means from the first position to the second position against the force of the biasing means to open the fuel delivery valve means so that the latter permits the flow of fuel to the burner means; the fuel cartridge further including moving means for moving the fuel delivery valve means of the fuel cartridge between an active position to enable actuation of the control means thereof by the plunger means of the actuator means and an inactive position at which the control means of the fuel cartridge is not actuated by the plunger means of the actuator means; and regulator means for maintaining a substantially constant temperature of the burner means.

The above and other, objects, features and advantages of the present invention will become readily apparent from the following detailed description which is to be read in connection with the accompanying drawings.

BRIEF DESCRIPTION OF THE DRAWINGS

FIG. 3 is a plan view of a portable curling iron according to another embodiment of the present invention; and FIG. 4 is a partial cross-sectional view of a portion of the portable curling iron of FIG. 3.

DETAILED DESCRIPTION OF THE PREFERRED EMBODIMENTS

Figure 1:
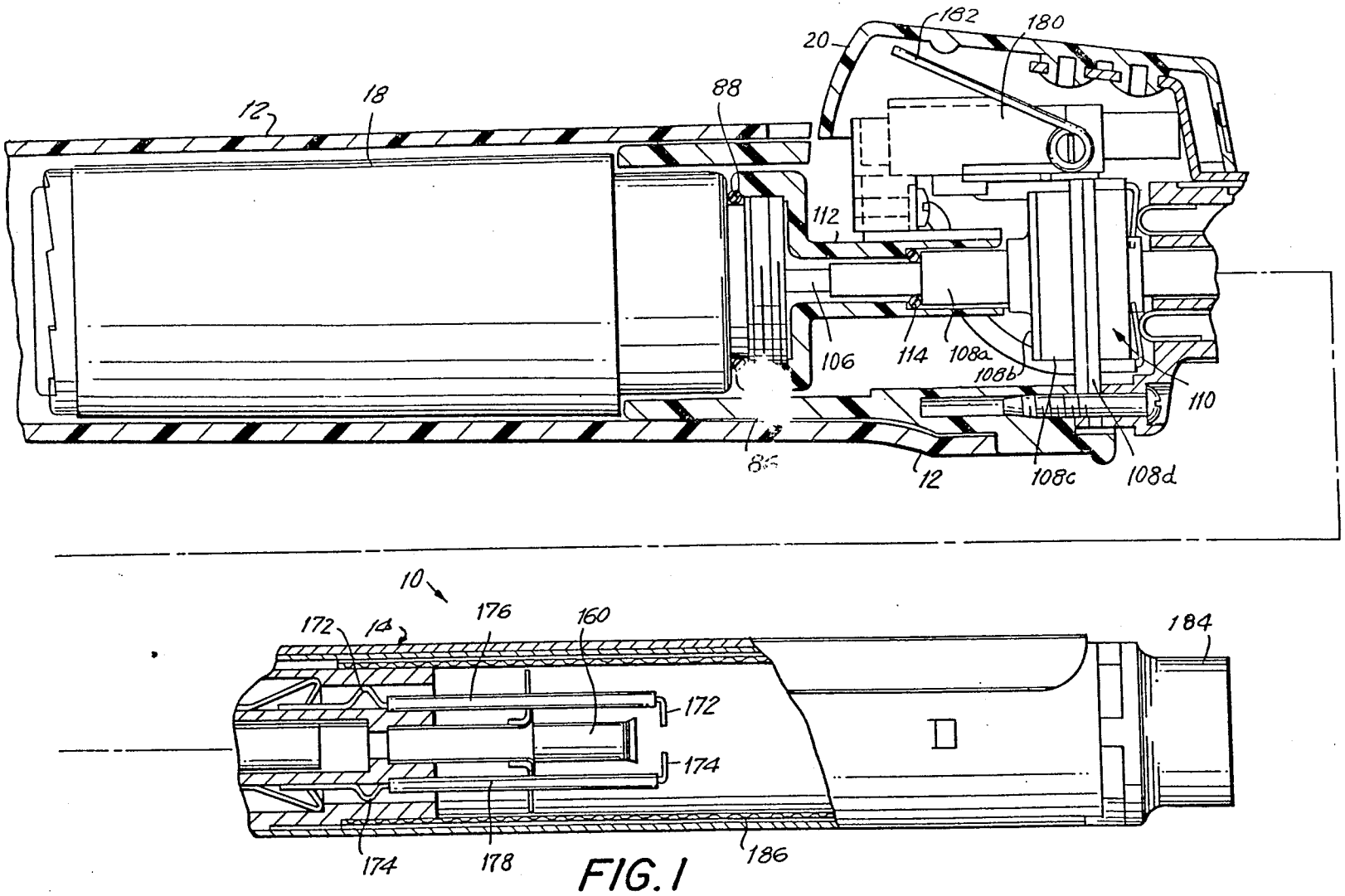
FIG. 1 is a partial cross-sectional view of a portable curling iron according to the present invention in its operative condition.
Figure 2:
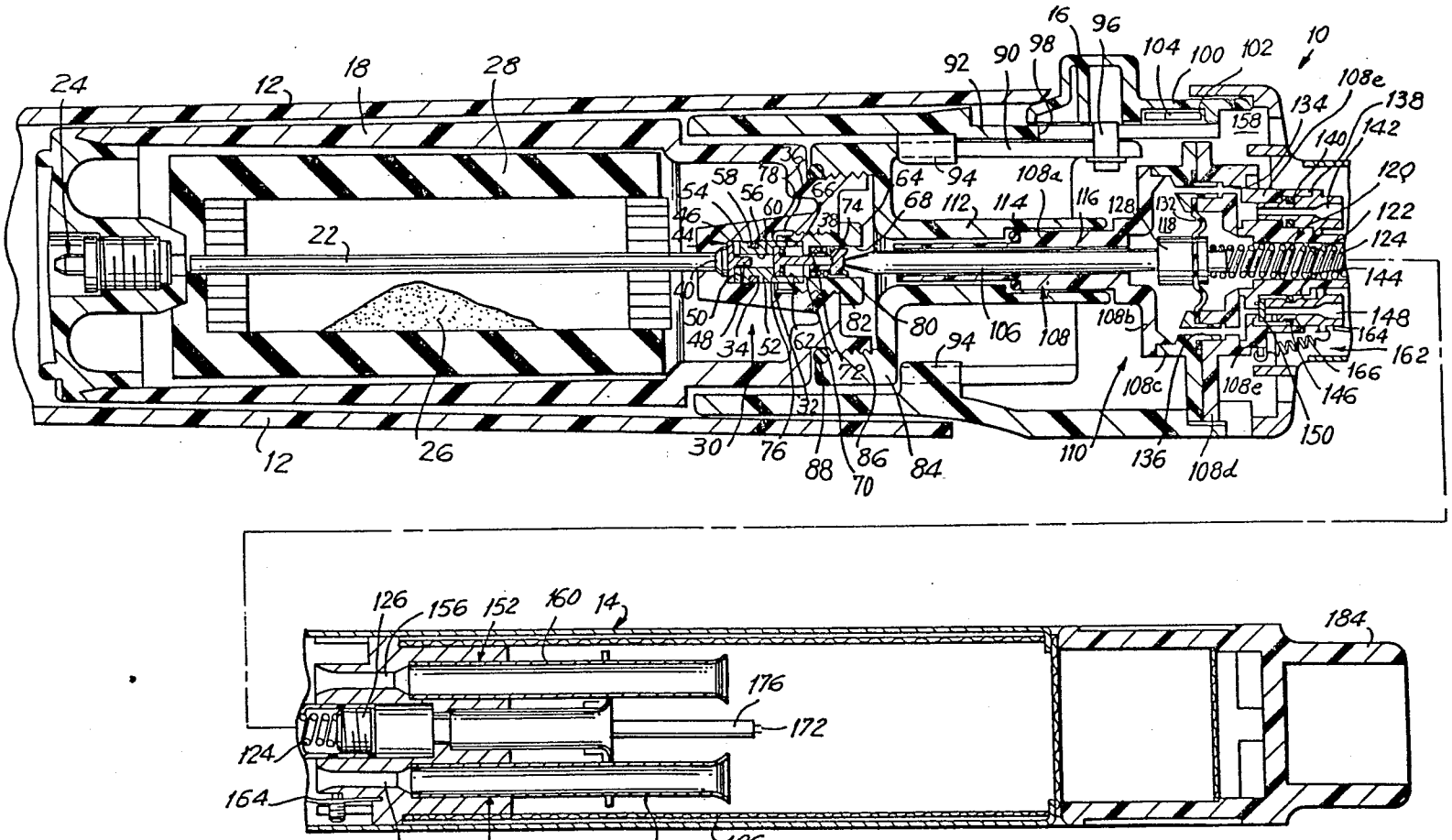
FIG. 2 is a partial cross-sectional view of the portable curling iron of FIG. 1, rotated by 90 degrees from FIG. 1.

Referring to the drawings in detail, a portable curling iron 10 according to the present invention includes a handle 12 which may be removed to serve as a cover over a barrel 14 thereof which is to be heated. Handle 12 is shown in FIGS. 1 and 2 in its operative condition, that is, removed from barrel 14. As shown in FIG. 2, when handle 12 is so positioned, it slides a switch button 16 to the right in FIG. 2 to the position shown. Switch button 16, as will be described in greater detail hereinafter, functions as an ON/OFF switch, to start the flow of a gas fuel, such as butane, from a fuel cartridge 18. Then, an ignitor push button 20 (FIG. 1) is depressed by the user to control a piezoelectric ignitor which ignites the butane to heat barrel 14.

As discussed, curling iron 10 is gas fueled, the gas being carried in fuel cartridge 18 and transported to the delivery end by a sintered plastic wick 22. Cartridge 18 may be refillable through a fill valve 24, or replaceable, as desired. As shown in FIG. 2, cartridge 18 includes a charcoal filter material 26 and a foam lining 28, as is conventional.

In addition, cartridge 18 includes a fuel delivery valve 30 at the end opposite fill valve 24. Specifically, fuel delivery valve 30 is assembled in a molded well 32 in the end of cartridge 18 which attaches to curling iron 10. Molded well 32 includes a smooth first section 34 having a first diameter, and a second section 36 having a second, larger diameter which is threaded as at 38.

Fuel delivery valve 30 includes an aluminum wick holder 40 press fit into the inner end of first section 34 of molded well 32. One end of sintered plastic wick 22 is pressed into wick holder 40 and the opposite end of wick 22 extends to near the bottom of cartridge 18 at the opposite end thereof. A cylindrical brass part 44 is positioned within well 32. Cylindrical brass part 44 includes a first section 46 adjacent wick holder 40 and having a diameter substantially equal to that of smooth first section 34, and a second shaft section 48 of a smaller diameter. A tube of compressible foam 50, which forms an adjustable flow restrictor, has a central opening and is located on second shaft section 48 of brass part 44, where the latter centers foam tube 50 within well 32. As will be appreciated from the discussion hereinafter, the degree of compression of foam tube 50 changes the flow rate of gas therethrough.

After the above has been assembled in well 32, the portion of fuel delivery valve 30 which compresses foam tube 50 is assembled in well 32. Specifically, a tubular brass spacer 52 having an outer diameter substantially equal to that of smooth first section 34 of well 32 is slidably fit therein. Spacer 52 includes an end face 54 which abuts against foam tube 50 to compress the same when a force is applied thereto. A circular groove 56 is formed in the outer surface of spacer 52 in which an O-ring 58 is inserted for preventing any leakage between the inner wall of well 32 and the outer surface of spacer 52. Spacer 52 includes a central bore 60 of substantially equal diameter to second shaft section 48 of cylindrical brass part 44 and which slidably fits thereover. Central bore 60 has an enlarged diameter, as at 62, at the opposite end thereof.

A cylindrical molded plastic upper valve housing 64 is provided with external threads which screw threadedly mate with threads 38 of second section 36 of well 32 for securing housing 64 therein. Housing 64 includes a first central, cylindrical recess 66 at one end which surrounds the outer surface of spacer 52, and a second central, cylindrical recess 68 at the opposite end, recesses 66 and 68 being separated by a wall 70 having a central aperture 72 therein. A stem 74 is slidably fit within aperture 72 and includes an enlarged head 76 on the end facing into cartridge 18, enlarged head 76 having an outer diameter substantially equal to that of enlarged diameter section 62 of central bore 60, but slidably fit therein. Thus, stem 74 is shaped like a tiny common nail, but with no sharp point. An annular rubber seal 78 is fit on stem 74 in abutment with enlarged head 76. The opposite end of stem 74 which extends to the opposite side of wall 70, is press fit into a plastic cap 80 which is slidably positioned within second cylindrical recess 68, plastic cap 80 being outwardly biased by a coil spring 82 also positioned within second cylindrical recess 68.

In operation, when no inwardly directed force is applied to plastic cap 80, coil spring 82 outwardly biases plastic cap 80, thereby causing annular rubber seal 78 to be biased to the right of FIG. 2 in contact with and sandwiched between enlarged head 76 and wall 70, to maintain annular rubber seal 78 in compression so as to prevent the flow of any gas from cartridge 18. As will be explained hereinafter, this occurs when cartridge 18 is not assembled with curling iron 10.

When an inwardly directed force is applied to plastic cap 80, the latter moves to the left of FIG. 2 to the position shown, compressing coil spring 82 and moving stem 74, enlarged head 76 and annular rubber seal 78 out of the sealing position, whereby gas can flow out of cartridge 18. The amount of gas flow will depend on the extent that foam tube 50 is compressed. It will be noted that, since housing 64 is screw threadedly received within well 32, the amount of leftward travel of stem 74 and enlarged head 76, and therefore the extent of compression of foam tube 50, will vary depending on the distance that housing 64 is screw threaded into well 32. Housing 64 is shown in FIG. 2 screw threaded to its maximum extent. The gas flow rate is preferably set at the factory and is not consumer adjustable.

As shown, cartridge 18 is secured to a sliding adapter 84 of curling iron 10 through screw threads 86 and is sealed with an O-ring 88 in a conventional manner. Sliding adaptor 84 includes an outer cylindrical section 90 which is slidably keyed within the proximal end of the housing 92 of curling iron 10 by at least one key element 94. Outer cylindrical section 90 is secured to switch buton 16. Specifically, switch button 16 includes a switch knob pin 96 which extends through an elongated slot 98 in housing 92. Switch button 16 is also formed with a forward extension 100 having a recess 102 facing housing 92 and in which a switch spring 104 is placed to normally bias switch button 16 to the left of FIG. 2.

Accordingly, when handle 12 is inserted over the proximal end of curling iron 10, it moves switch button 16 to the right of FIG. 2 to the position shown. As a result, cartridge 18 is also moved to the right of FIG. 2 and, as will be described hereinafter, gas flow is started. When handle 12 is removed and placed over barrel 14 to function as a cover, switch spring 104 moves button 16 to the left of FIG. 2, thereby also moving cartridge 18 to the left, to stop the flow of gas.

Specifically, when cartridge 18 is moved to the right of FIG. 2, as shown, a plunger 106 hits against plastic cap 80 to move stem 74 and annular rubber seal 78 out of the aforementioned sealing arragement to permit the flow of gas. When cartridge 18 is moved to the left of FIG. 2, plunger 106 no longer applies a depressing force to plastic cap 80. As a result, coil spring 82 biases plastic cap 80, stem 74, enlarged head 76 and annular rubber seal 78 to the right of FIG. 2 in the aformentioned sealing arrangement to prevent any flow of gas from cartridge 18.

Plunger 106 is slidably received within a regulator housing 108 of a rectangular assembly 110 which, in turn, is slidably received within a central cylindrical section 112 of sliding adapter 84. An O-ring 114 provides a sliding seal between a first section **108*a* of regulator housing 108 and cylindrical section 112. Thus, gas can only flow from cartridge 18 through a gap 116 provided between plunger 106 and first section 108*a* of regulator housing 108**.

The purpose of regulator assembly 110 is to provide vaporized fuel at constant pressure independent of ambient temperature, fuel consumption rate, orientation, brand of fuel and fuel level. Thus, a known amount of heat is produced at all times, corresponding to fuel consumption. In other words, the burners at maintained at a constant temperature. Therefore, temperature regulation is not necessary to maintain barrel temperature during use and because of this, curling iron 10 according to the present invention is easier to assemble and adjust than prior butane curling irons.

As shown in FIG. 2, first section **108*a* of regulator housing 108 includes a radially directed section 108*b* at the end thereof which extends from cylindrical section 112. Radially directed section 108*b* is connected to a second section 108*c* of regulator housing 108 which, in turn, is connected to a third section 108*d* thereof. The latter section 108*d* is connected to still a fourth section 108*e* of regulator housing 108. Of course, all of the sections of regulator housing 108 can be constructed in a one piece molding operation. Radially directed section 108*b* and second, third and fourth sections 108*c*, 108*d* and 108*e*, respectively, define a gas flow chamber 118 through which gas flows from gap 116 between first section 108*a* of regulator housing 108 and plunger 106**.

Regulator assembly 110 further includes an inner assembly 120 within chamber 118 and which defines a central bore 122 which houses a coil spring 124. An adjusting screw 126 is screw threadely received within central bore 122, against which one end of coil spring 124 abuts. A plunger stopper 128 is secured to one end of plunger 106, and includes a central boss 130 at the opposite end thereof. The opposite end of coil spring 124 surrounds and is centered by boss 130 and abuts against the respective end face of plunger stopper 128. Thus, coil spring 124 pushes on plunger 106, biasing it in the direction of cartridge 18 into abutment with plastic cap 80 of fuel delivery valve 30 when cartridge 18 is secured to curling iron 10. Butane gas therefore flows from cartridge 18, through gap 116 to chamber 118.

A rubber diaphragm 132 is secured to inner assembly 120 and to plunger stopper 128. When the pressure of the fuel entering chamber 118 becomes too great, rubber diaphragm 132 is biased to the right of FIG. 2 against the force of coil spring 124, to move plunger 106 away from fuel delivery valve 30, whereby coil spring 82 of fuel delivery valve 30 causes it to close, halting the flow of gas. Once the gas pressure is reduced by burning the fuel, coil spring 124 moves rubber diaphargm 132 and plunger 106 to the left of FIG. 2 to the position shown, to once again open fuel delivery valve 30. This cycle continues and maintains a constant pressure on the outlet side of regulator assembly 110 as long as switch 16 remains in the ON position. It will be appreciated that, turning adjusting screw 126, alters the compression of coil spring 124, thus adjusting the gas flow pressure.

Regulator housing 108 and inner assembly 120 define two narrow channels 134 and 136 therebetween through which gas from chamber 118 escapes, each channel leading toward a respective orifice-venturi-burner assembly. Specifically, channel 134 leads to a valve stem 138 positioned within a recess defined between fourth section **108*e* of regulator housing 108 and inner assembly 120. An O-ring 140 surrounds valve stem 138 at mid-length to provide a gas tight seal. Valve stem 138 includes a central bore which defines a gas flow orifice 142 in fluid communication with channel 134**.

In like manner, a valve stem 144 is positioned within a recess defined between fourth section **108*e* of regulator housing 108 and inner assembly 120, diametrically opposite valve stem 138. An O-ring 146 surrounds valve stem 144 at mid-length to provide a gas tight seal. In addition, valve stem 144 includes a central bore which defines a gas flow orifice 148 in fluid communication with channel 136. An annular, resilient valve pad 150 is positioned at the end of valve stem 144 between channel 136 and orifice 148. As will be appreciated from the description which follows, O-ring 146 acts as the fulcrum of a lever, whereby valve stem 144 can rotate or rock thereabout to make a break a seal between channel 136 and orifice 148, by means of valve pad 150. Thus, when valve stem 144 is axially in line with barrel 14, there is no gas seal, and butane vapors flow from channel 136, through the central aperture of valve pad 150 to orifice 148. On the other hand, when valve stem 144 is tilted or rotated about O-ring 146, the central aperture of valve pad 150 is out of line with channel 136 and orifice 148, so that a seal is provided which blocks the passage of gas to orifice 148**.

The butane vapor from orifice 142 leads to a main burner 152, while the butane vapor from orifice 148 leads to a fast heat up burner 154. The burners differ in purpose, and each will be discussed beginning with main burner 152.

The purpose of main burner 152 is to provide enough heat to maintain barrel 14 at a desired temperature during use. After the butane vapor leaves orifice 142, it passes through a venturi tube 156, where air supplied from an annular chamber 158 is entrained to make a combustible mixture. Orifice 142 is of sufficient size to increase the velocity of the butane vapor so that the correct amount of air for efficient burning will be entrained in venturi tube 156. The size of the orifice determines how much fuel enters each burner at a given pressure. The amount of fuel determines the heat up rate and equilibrium temperature attained. The air-butane vapor mixture then travels down a stainless steel tube 160 to the opposite end thereof where ignition and combustion occur. There, the fuel is ignited by an electric spark when the ignition push button 20 is pressed, and burns as long as ON/OFF switch button 16 is ON.

The purpose of the fast heat up burner 154 is to reduce the time required to heat barrel 14 from ambient to working temperature. It differs from main burner 152 by virtue of a thermostatically controlled valve assembly 162 which allows fuel to flow until barrel 14 reaches a predetermined temperature at which point a bimetallic element 164 thereof, secured to barrel 14 and to valve stem 144, deflects, and a spring 166 secured to fourth section 108*e* of regulator housing 108 and valve stem 144, pivots valve stem 144 about O-ring 146, whereby valve pad 150 provides a seal to prevent fuel flow through orifice 148 of valve stem 144. When barrel 14 is not at the predetermined temperature, bimetallic element 164 applies a force to valve stem 144, normal to its axis and against the force of spring 166, to maintain orifice 148 of valve stem 144 in its open condition, whereby butane vapor enters orifice 148 and then travels through a venturi tube 168 where it is entrained with air from annular chamber 158. As with orifice 142, orifice 148 is of sufficient size to increase the velocity of the butane vapor so that the correct amount of air for efficient burning will be entrained in venturi tube 168. The air-fuel mixture from venturi tube 168 travels down a stainless steel tube 170 to the opposite end thereof where ignition and combustion occur. The heat produced by fast heat up burner 154 approximately doubles the heat output of curling iron 10. Of course, with orifice 148 closed by thermostatically controlled valve assembly 162, there is no combustion and therefore no heat.

Therefore, the burner system consists of two parallel paths, each with the same capacity, but one being controlled by regulator assembly 110 and bimetallic element 164 and the other being controlled regulator assembly 110 alone. Each path terminates in a stainless steel tube 160 or 170 having an open end where the air-gas mixture is ignited and burned.

Ignition is accomplished by an electric spark traveling from electrodes 172 and 174 to the ends of stainless steel tubes 160 and 170, where combustion takes place, as shown in FIG. 1. Specifically, electrodes 172 and 174 are encased partially in ceramic tubes 176 and 178, respectively, with the ends thereof being exposed at the ends of stainless steel tubes 160 and 170, as shown. The opposite ends of electrodes 172 and 174 extend into electrical contact with a piezoelectric crystal 180 which generates a spark when struck by a spring loaded hammer 182 when ignition push button 20 is pressed. Ignition push button 20 is mounted between cartridge 18 and regulator assembly 110, measured in the lengthwise direction of curling iron 10, so that ignition push button 20 is next to ON/OFF switch button 16.

Thus, to operate curling iron 10, handle 12 is removed from barrel 14 and positioned over cartridge 18, where it biases switch button 16 to the right of FIG. 2, to turn ON the flow of butane gas. Then, ignition push button 20 is pressed once or twice to ignite the gas-air mixture at the end of stainless steel tubes 160 and 170. Initially, both burners 152 and 154 are activated to quickly bring barrel 14 up to the predetermined temperature. Once this temperature is attained, bimetallic element 164 deflects and spring 166 pivots valve stem 144 about O-ring 146 to prevent the flow of gas therethrough, and thereby shut off fast heat up burner 154. The predetermined temperature is then maintained by regulator assembly 110 which is initially set for the particular desired temperature. As the gas flow increases too much, whereby the temperature also rises, the gas flow is cut off, until the pressure in chamber 118 decreases (corresponding to the desired temperature).

A cool tip 184 is located on the open end of barrel 14. It is molded of high temperature resistant plastic which is also low in thermal conductivity. This component provides a gripping surface, and because it is tubular in shape, exhaust gases escape through its screened open end.

Further, the combustion area of curling iron 10 is surrounded by an expanded aluminum or wire woven screen 186. The purpose of screen 186 is to even out the temperature of the exhaust gases, all of which must pass through it. Additionally, exhaust ports (not shown) in barrel 14, which are conventional, have screens (not shown) of the same expanded aluminum, yielding a double flame arresting barrier against hot exhaust gases (even during ignition). Thus, curling iron 1 can be started and run in an explosive atmosphere of common household solvents with no danger of curling iron 10 starting a fire or explosion.

Although the present invention has been described for use with a curling iron, clearly, the fuel supply, regulator assembly and fast heat up and main burners are useable in many environments in which fast heat up and settable barrel temperatures are desirable. The following products are a representative list of those which could readily use the above elements either alone or in combination:

1. Curling iron
2. Travel setter
3. Facial hand unit
4. Travel flat iron
5. Travel flat iron with steam
6. Clothes dewrinkler
7. Contact lens sterilizer
8. Travel hot plate
9. Hot tray
10. Gas match
11. Lantern
12. Bottle warmer
13. Hot liquids container
14. Hot bladed knife
15. Solder iron
16. Hot melt gun
17. Travel stove
18. Pocket hands warmer
19. Paint stripper
20. Heat massager
21. Hair dryer It will also be appreciated that the regulator assembly has independent value and can be used without the two burner system. In like manner, the two burner system can be used without the regulator assembly.

Referring now to FIGS. 3 and 4, a portable curling iron 210 according to another embodiment of the present invention will now be described, in which elements corresponding to those in the embodiment of FIGS. 1 and 2 are identified by the same reference numerals augmented by 200, and a detailed description thereof will not be given for the sake of brevity.

Specifically, adapter 284 is not slidable, but rather, is fixed to the housing of portable curling iron 210. Also, cylindrical section 312 of adapter 284 is formed with a larger inside diameter, and first section 308*a* of regulator housing 308 is formed with a larger outer diameter which fits within cylindrical section 312 of adapter 284. As shown in FIG. 4, first section 308*a* extends out of cylindrical section 312, unlike the embodiment of FIGS. 1 and 2.

A central bore 315 having a first diameter extends through first section 308*a* and terminates, at the free end of first section 308*a* which extends out of cylindrical section 312, in a central bore 317 having a larger diameter. Plunger 306 is slidably fit within bores 315 and 317, and a gap 316 is provided in central bore 315, between plunger 306 and first section section 308*a* to permit gas flow from cartridge 218 through gap 316. It is further noted that plunger 306 extends through bore 315 and only partially into central bore 317.

The principal difference between portable curling iron 210 and portable curling iron 10 is the fuel cartridge that is used.

As with cartridge 18, fuel cartridge 218 is secured to adapter 284 through screw threads 286 on adapter 284 which mate with screw threads 219 on cartridge 218. In addition, the gas in cartridge 218 is transported to the delivery end thereof by a sintered plastic wick 222. Although not shown, it will further be appreciated that cartridge 218 includes a charcoal filter material and a foam lining, as is conventional.

Cartridge 218 has a molded well 232 at the end thereof which attached to curling iron 210. Molded well 232 includes a smooth first section 234 having a first diameter, and a second section 235 having a second, larger diameter which is threaded as at 238. Sintered plastic wick 222 extends into first section 234 of molded well 232 for delivering fuel thereto.

A fuel delivery valve 230 is assembled in molded well 232. Fuel delivery valve 230 may be constructed similarly to fuel delivery valve 30, and thereby operates in a similar manner. Thus, the details of fuel delivery valve 230 are not shown. When plunger 306 pushes cap 380 inwardly, the latter moves to the left of FIG. 4 to permit gas flow out of cartridge 218. The amount of gas flow will depend on the extent that cap 380 is moved.

In accordance with the second embodiment of the invention, fuel delivery valve 230 has a first end 230*a* slidably received in first section 234 of molded well 232 and a second, opposite end 230*b* thereof slidably received in central bore 317 of first section 308*a* of regulator housing 308. In this regard, first end 230*a* is formed with a circmumferential groove 256 which receives two O-rings 258 for preventing any leakage between the inner wall of well 232 and the outer surface of first end 230*a* of fuel delivery valve 230, while permitting sliding movement of fuel delivery valve 230 in first section 230*a* of molded well 232. In like manner, second end 230*b* is formed with a circumferential groove 257 which receives two O-rings 259 for preventing any leakage between the inner wall of first section 308*a* of regulator housing 308 and the outer surface of second end 230*b* of fuel delivery valve 230, while permitting sliding movement of fuel delivery valve 230 in first section 308*a* of regulator housing 308.

Fuel delivery valve 230 also includes external threads 231 which threadedly mate with screw threads 238. Thus, depending upon the direction of rotation, fuel delivery valve 230 is moved to the left or right of FIG. 4. A ring 233 is rotatably secured at the front end of cartridge 218, and a connecting rod 235 connects ring 233 to fuel delivery valve 230. In this manner, the user can rotate ring 233, and thereby rotate fuel delivery valve 230 in molded well 232.

With this arrangement, when ring 233 is rotated to the position shown in FIG. 3, fuel delivery valve 230 is moved to the position shown in FIG. 4. In this position, plunger 306 pushes in cap 380 to cause the flow of fuel to from cartridge 218 so as to supply fuel to the burners. On the other hand, when ring 233 is rotated to the OFF position of FIG. 3, fuel delivery valve 230 is moved to the left in FIG. 4. In this position, plunger 306 cannot push in cap 380 so that there is no fuel from cartridge 218. Therefore, to operate portable curling iron 210, ring 233 must be rotated to its ON position, as shown in FIG. 3, whereby plunger 306 engages with fuel delivery valve 230 to start the flow of fuel from cartridge 218.

Having described specific preferred embodiments of the invention with reference to the accompanying drawings, it will be appreciated that the present invention is not limited to those precise embodiments and that various changes and modifications can be affected therein by one of ordinary skill in the art without departing from the spirit and scope of the invention as defined by the appended claims.

What is claimed is:

1. A fuel cartridge for supplying fuel to burner means of a portable heating appliance of the type having a member to be heated, comprising:

housing means for containing fuel;

a well in said housing means for permitting escape of said fuel;

fuel delivery valve means for controlling the flow of fuel from said fuel cartridge through said well, said fuel delivery valve means including:

control means for preventing the flow of fuel when in a first position and for permitting the flow of fuel when biased by an external force to a second, different position;

first biasing means for biasing said control means to said first position in a direction opposite to said external force; and moving means for moving said fuel delivery valve means between an active position to enable actuation of said control means by said external force and an inactive position at which said control means is not actuated by said external force.

2. A fuel cartridge according to claim 1; wherein said housing means includes first threads in surrounding relation to said well, said fuel delivery valve means is positioned in said well and includes second threads for threadedly mating with the first threads of said housing means, and said moving means includes rotation means for rotating said fuel delivery valve means so as to move said fuel delivery valve means between said active and inactive positions.

3. A fuel cartridge according to claim 2; wherein said fuel delivery valve means includes a first end slidably received in said well, a second end slidably received in a regulator housing of said portable heating appliance, and said second threads are positioned externally on said fuel delivery valve means between said first and second ends.

4. A fuel cartridge according to claim 3; wherein said first end includes a first circumferential groove and first sealing means therein for providing a fluid seal between said first end and said well while permitting sliding of said first end in said well, and said second end includes a second circumferential groove and second sealing means therein for providing a fluid seal between said second end and said regulator housing while permitting sliding of said second end in said regulator housing.

5. A fuel cartridge according to claim 4; wherein said first sealing means includes at least one O-ring in said first circumferential groove and said second sealing means includes at least one O-ring in said second circumferential groove.

6. A fuel cartridge according to claim 2; wherein said rotation means includes a manually actuable ring rotatably mounted on said housing means, and connecting means for connecting said ring to said fuel delivery valve means such that said fuel delivery valve means rotates with said ring.

7. A portable heating appliance having a member to be heated, comprising:

burner means for heating said member;

a portable fuel cartridge for supplying fuel to said burner means, said fuel cartridge including fuel delivery valve means for controlling the flow of fuel from said fuel cartridge, said fuel delivery valve means including control means for preventing the flow of fuel when in a first position and for permitting the flow of fuel when in a second, different position, and first biasing means for biasing said control means to said first position;

actuator means for actuating said fuel, delivery valve means in response to user actuation to start the flow of fuel from said fuel cartridge, said actuator means including plunger means which pushes in said control means from said first position to said second position against the force of said biasing means to open said fuel delivery valve means so that the latter permits the flow of fuel to said burner means;

said fuel cartridge further including moving means for moving said fuel delivery valve means of said fuel cartridge between an active position to enable actuation of said control means thereof by said plunger means of said actuator means and an inactive position at which said control means of said fuel cartridge is not actuated by said plunger means of said actuator means; and regulator means for maintaining a substantially constant temperature of said burner means.

8. A portable heating appliance according to claim 7; wherein said fuel cartridge includes housing means for containing fuel and a well in said housing means for permitting escape of said fuel, said housing means having first threads in surrounding relation to said well, said fuel delivery valve means being positioned in said well and including second threads for threadedly mating with the first threads of said housing means, and said moving means includes rotation means for rotating said fuel delivery valve means so as to move said fuel delivery valve means between said active and inactive positions.

9. A portable heating appliance according to claim 8; further including a regulator housing in surrounding relation to said plunger means; and wherein said fuel delivery valve means includes a first end slidably received in said well, a second end slidably received in said regulator housing of said portable heating appliance, and said second threads are positioned externally on said fuel delivery valve means between said first and second ends.

10. A portable heating appliance according to claim 9; wherein said first and end includes a first circumferential groove and first sealing means therein for providing a fluid seal between said first end and said well while permitting sliding of said first end in said well, and said second end includes a second circumferential groove and second sealing means therein for providing a fluid seal between said second end and said regulator housing while permitting sliding of said second end in said regulator housing.

11. A portable heating appliance according to claim 10; wherein said first sealing means includes at least one O-ring in said first circumferential groove and said second sealing means includes at least one O-ring in said second circumferential groove.

12. A portable heating appliance according to claim 8; wherein said rotation means includes a manually actuable ring rotatably mounted on said housing, and connecting means for connecting said ring to said fuel delivery valve means such that fuel delivery valve means rotates with said ring.

13. A portable heating appliance according to claim 7; wherein said burner means includes first and second burners for heating said member; and further including means for terminating the flow of fuel to said second burner when a predetermined temperature is reached.

14. A portable heating appliance according to claim 13; further comprising conduit means for carrying said fuel from said fuel cartridge to said first and second burners; and said means for terminating includes means for preventing the flow of fuel through said conduit means to said second burner.

15. A portable heating appliance according to claim 14; wherein said conduit means includes first valve stem means for carrying said fuel from said fuel cartridge to said first burner and second valve stem means for carrying said fuel from said fuel cartridge means to said second burner, said second valve stem means being movable between a first position to permit the flow of fuel from said fuel cartridge to said second burner and a second position to prevent the flow of fuel from said fuel cartridge to said second burner; and wherein said means for preventing includes first biasing means for moving said second valve stem means to said first position when the temperature is less than said predetermined temperature and second biasing means for moving said second valve stem means to said second position when the temperature is at least equal to said predetermined temperature.

16. A portable heating appliance according to claim 15; wherein said second valve stem means includes a fuel flowing orifice; and further including channel means for supplying said fuel from said fuel cartridge to said orifice of said second valve stem means, and valve pad means positioned between said channel means and said orifice for permitting the flow of fuel to said orifice when said second valve stem means is in said first position and for preventing the flow of fuel to said orifice when said second valve stem means is in said second position.

17. A portable heating appliance to claim 15; wherein said first biasing means includes a bimetallic element which biases said second valve stem means to said first position when said temperature is less than said predetermined temperature and which removes said bias when the temperature is at least equal to said predetermined temperature; and said second biasing means includes spring means which biases said second valve stem means to said second position when the temperature is at least equal to said predetermined temperature and said bimetallic element removes said bias therefrom.

18. A portable heating appliance according to claim 15; wherein said actuator means includes second biasing means for applying a force to said plunger means to bias the latter into engagement with said fuel delivery valve means to control the latter to permit the flow of fuel from said fuel cartridge.

19. A portable heating appliance according to claim 18; wherein said regulator means includes diaphragm means for applying a force to said plunger means against the force from said second biasing means when the pressure of said fuel from said fuel cartridge is greater than a second predetermined pressure to control said fuel delivery valve means to prevent the flow of fuel from said fuel cartridge.

20. A portable heating appliance according to claim 18; wherein said actuator means includes means for adjusting the force applied by said second biasing means to said plunger means.

21. A portable heating appliance according to claim 20; wherein said second biasing means includes a coil spring applying a force against said plunger means, and said means for adjusting includes an adjusting screw against which one end of said coil spring abuts and which is adjustable to vary the force applied by said coil spring to said plunger means.

22. A portable heating appliance according to claim 7; wherein said portable heating appliance is a portable curling iron.

* * * * *